US005795276A

United States Patent [19]

Almeda

[11] Patent Number: 5,795,276

[45] Date of Patent: Aug. 18, 1998

[54] STRETCHING AND EXERCISE DEVICE

[76] Inventor: T. Michael Almeda, 14 Aster Ter., Key West, Fla. 33040

[21] Appl. No.: 695,783

[22] Filed: Aug. 12, 1996

Related U.S. Application Data

[63] Continuation-in-part of Ser. No. 334,954, Nov. 7, 1994, Pat. No. 5,584,786, which is a continuation-in-part of Ser. No. 10,503, Jul. 7, 1993, Pat. No. Des. 353,173.

[51] Int. Cl.[6] ..... A63B 26/00

[52] U.S. Cl. ..... 482/142; 606/240; 482/140

[58] Field of Search ..... 482/142, 140; 5/630; 297/452.12, 452.14, 452.17; 606/240

[56] References Cited

U.S. PATENT DOCUMENTS

| | | | |
|---|---|---|---|
| 2,544,800 | 3/1951 | Michaelis | 297/452.12 |
| 3,124,289 | 3/1964 | Mikan | 297/452.17 |
| 3,753,592 | 8/1973 | Jensen | 297/452.17 |
| 4,027,888 | 6/1977 | Wilcox | 297/452.17 |
| 4,359,245 | 11/1982 | Franke | 297/452.17 |
| 4,564,240 | 1/1986 | Thieme | 297/452.14 |
| 5,141,285 | 8/1992 | Park | 297/452.12 |
| 5,474,513 | 12/1995 | Carlesimo et al. | 482/142 |

*Primary Examiner*—Lynne A. Reichard
*Attorney, Agent, or Firm*—Malloy & Malloy, P.A.

[57] ABSTRACT

A portable, easy to use exercise device suited for various types of sit-up type exercises to increase muscular flexibility and generally strengthen the abdominal and back muscles while substantially minimizing stress to the lower back region. The exercise device includes a platform formed of a rigid material structured for supporting an exerciser's body weight. The platform includes a top region, a bottom region, a first end zone, and a second end zone. The top region of the platform defines an upper support surface for contacting and supporting the exerciser. The upper support surface has a generally sinusoidal configuration between the first and second end zones. The upper support surface includes a convex support portion for supporting the exerciser's back so as to cause it to partially arch when the exerciser reclines back. The upper support surface further includes a concave cradle portion for supporting and cradling the exerciser's buttocks during the performance of exercises. The bottom region defines a bottom surface having a generally sinusoidal configuration between the first and second end zones and corresponding to the generally sinusoidal configuration of the upper support surface. The bottom region of the platform is structured to contact and support the device on a common planar surface when the device is in an operative position.

15 Claims, 3 Drawing Sheets

STRETCHING AND EXERCISE DEVICE

STATEMENT OF RELATED APPLICATIONS

This application is a continuation-in-part to the application having Ser. No. 08/334,954, filed on Nov. 7, 1994, now U.S. Pat. No. 5,584,786, which is a continuation-in-part to the application filed Jul. 7, 1993, having Ser. No. 29/010,503, now U.S. Pat. No. Des. 353,173, granted Dec. 6, 1994, both of which are incorporated herein by reference.

BACKGROUND OF THE INVENTION

1. Field of the Invention

The present invention relates in general to a stretching and exercise device and in particular to a portable, easy to use device especially suited for stretching so as to permit one to increase his or her muscle flexibility and which is also suited for performing sit-up type exercises for one to strengthen his or her abdominal muscles, as well as back muscles, while causing little or no stress to the lower back region. The exercise device of the present invention is also structured to be compact and easily stored, and further, a plurality of the devices may be conveniently stacked or otherwise stored in a space-saving manner so as to facilitate use in health clubs, gyms, schools, and the like where storage space is limited.

2. Description of the Related Art

It is now well understood that stretching and exercising are both important and beneficial to the human body. In recent years, it has become evident that when some form of regular exercise is incorporated into a person's daily routine along with a healthy diet, it helps him or her to maintain a positive outlook, to extend life and to avoid many of the difficulties typically associated with old age. As a result, numerous devices relating to exercise have been developed in recent years. Some are designed to provide a user with a cardiovascular workout, while others offer resistance-type exercise. Yet other exercise devices allow the user to isolate a particular muscle group such as the leg muscles or the abdominal muscles, and focus on exercising that particular muscle group. The present invention relates to the latter type of devices in that it can be utilized to assist one in focusing on the abdominal muscle group by performing sit-up type exercises. The present invention can, however, also be utilized for simply warming-up the muscles of one's torso, chest and back in preparation for other exercise as well as for simply stretching those muscles so as to improve one's flexibility, to ease tension and/or to help prevent stress related injuries.

As one example, it has long been understood that sit-up type exercises are highly beneficial. Unfortunately, if sit-up type exercises are not done properly, they can cause undue stress and trauma to the lower back region. Consequently, many known devices for assisting with sit-up type exercises have been developed. However, nothing in the prior art discloses or suggests the present invention. More specifically, there remains a need in the art for an exercise device which is shaped to support and reduce the stress on the back of the exerciser during the performance of sit-up type exercises, while at the same time, permitting the exerciser to strengthen other muscle groups in the back region, which interconnect with the abdominal muscles and which provide support for the back and spinal column. There is also a need to provide such a device which is of unitary construction, portable and easy-to-use. In addition to being compact and portable, any such device should be capable of being easily stored, and ideally, would be capable of being conveniently stacked in a nesting arrangement with like devices for space-saving storage in health clubs, gyms, and similar places where many such devices may be maintained. Ideally, any such stretching or exercise device will also provide relative comfort to a person when it is being used in the performance of either stretching or sit-up type exercises and thereby, serve to improve the psychological attitude of the exerciser and to motivate him or her to continue exercising.

SUMMARY OF THE INVENTION

The present invention is directed towards a stretching and exercise device which is especially suited for stretching so as to permit one to increase his or her muscle flexibility and which is also especially suited for performing sit-up type exercises for one to strengthen his or her abdominal muscles, as well as muscle groups of the back. The present invention is structured and disposed to cause little or no stress to the exerciser's lower back region when the exerciser performs exercises thereon and to cause an exerciser to become more limber, and thereby, improve the overall wellness of the exerciser.

More specifically, the stretching and exercise device of the present invention comprises a platform formed of a rigid material, which is structured and disposed for supporting an exerciser's body weight thereon. The platform can be seen to include a top region, a bottom region, a first end zone and a second end zone. The top region of the platform defines an upper support surface having a generally sinusoidal configuration between the first and second end zones and further, includes a convex support portion and a concave cradle portion. The convex support portion is structured and disposed to support a substantial portion of an exerciser's back, and to cause the exerciser's back to at least partially arch when the exerciser reclines thereagainst. The concave cradle portion is structured and disposed to support and cradle the exerciser's buttocks when the exerciser performs exercises on the device. In addition, the bottom region of the platform is structured and disposed to contact and support the device in an operative position on a common planar surface.

A primary object of the present invention is to provide a stretching and exercise device which substantially supports the back of an exerciser when he or she is performing stretching, warm-up or sit-up type exercises thereon, so as to minimize pressure on the lower lumbar region of the exerciser's back.

Another primary object of the present invention is to provide a stretching and exercise device for enabling an exerciser to arch his or her back and thereby, expand the chest cavity so as to cause the exerciser to become more limber, to breathe more deeply, and thereby, to ease tension and/or to help prevent stress related injuries.

It is an object of the present invention to provide a stretching and exercise device for enabling one to warm-up the muscle groups of the chest, stomach and back prior to performing other exercises as well as for enabling one to perform stretching exercises so as to improve flexibility and to achieve a greater range of motion.

It is also an object of the present invention to provide a stretching and exercise device for enabling an exerciser to safely perform sit-up type exercises which are effective to strengthen and tone the abdominal muscles and interconnected muscle groups such as those supporting the back and spinal column.

Still another object of the present invention is to provide a one-piece exercise device which is lightweight and portable so as to allow it to be easily transported from location to location.

Another object of the present invention is to provide a stretching and exercise device which is compact and easy to store, and further, which is structured to be stackable, one on top of the other, with other like devices, so as to permit space-saving storage of large quantities of the present invention that may be maintained in gyms, health clubs, schools, hospitals, and the like.

Yet another object of the present invention is to provide a stretching and exercise device which is relatively easy and inexpensive to manufacture.

A feature of the present invention is that it can either be used directly on a floor surface or be mounted to a standard exercise bench of the kind found in gymnasiums, athletic clubs, homes, and the like.

An advantage of the present invention is that it can easily be utilized by all types of exercisers whether young or old, short or tall, athletic or not.

Another advantage of the present invention is that it can be used in routines for both advanced and beginning exercisers.

Yet another advantage of the present invention is that it improves the exerciser's psychological attitude towards exercising in general, and towards performing stretching, sit-up type and warm-up exercises in particular.

Still another advantage of the present invention is that it is designed to be attractive and if desired, may be colorful and may also include indicia thereon.

Other objects, features and advantages will become more readily apparent from the drawings and the detailed description of the invention, which follows.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As illustrated in FIGS. 1–7, the present invention is directed towards a stretching and exercise device, generally indicated as 10 or 110 which is especially suited for stretching exercises so as to permit one to increase muscle flexibility and which is also especially suited for performing sit-up type exercises for one to strengthen abdominal muscles, as well as the muscle groups of the back. It should be noted that although this description of the present invention is directed towards using the device 10 for stretching and exercising, significant benefits can be derived from simply laying on the device so as to comfortably hyperextend the back muscles.

Figure 1:
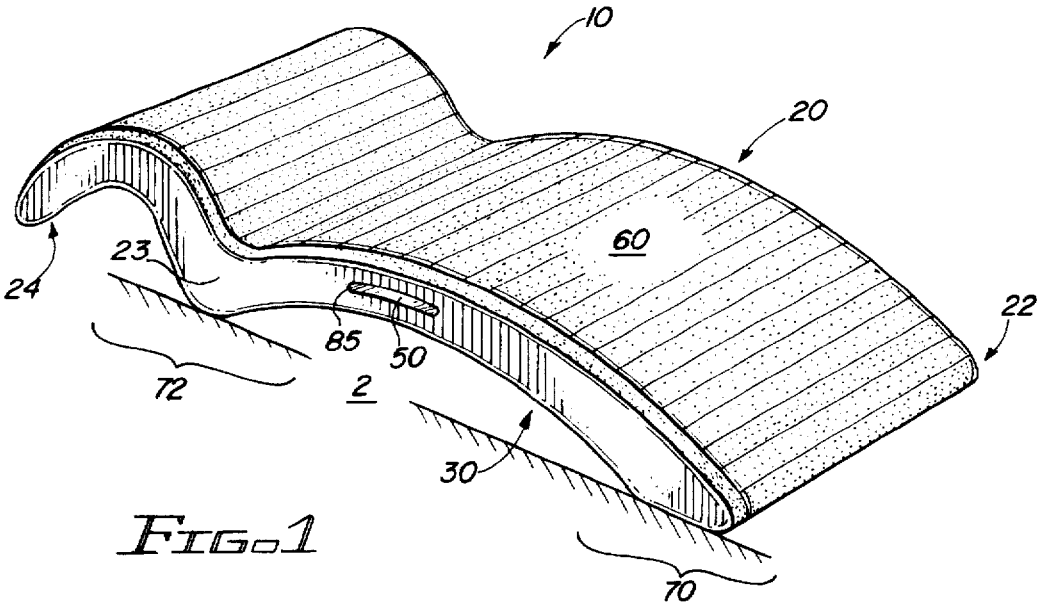
FIG. 1 is a perspective view showing a preferred embodiment of the stretching and exercise device according to the present invention as supported on a floor surface.
Figure 2:
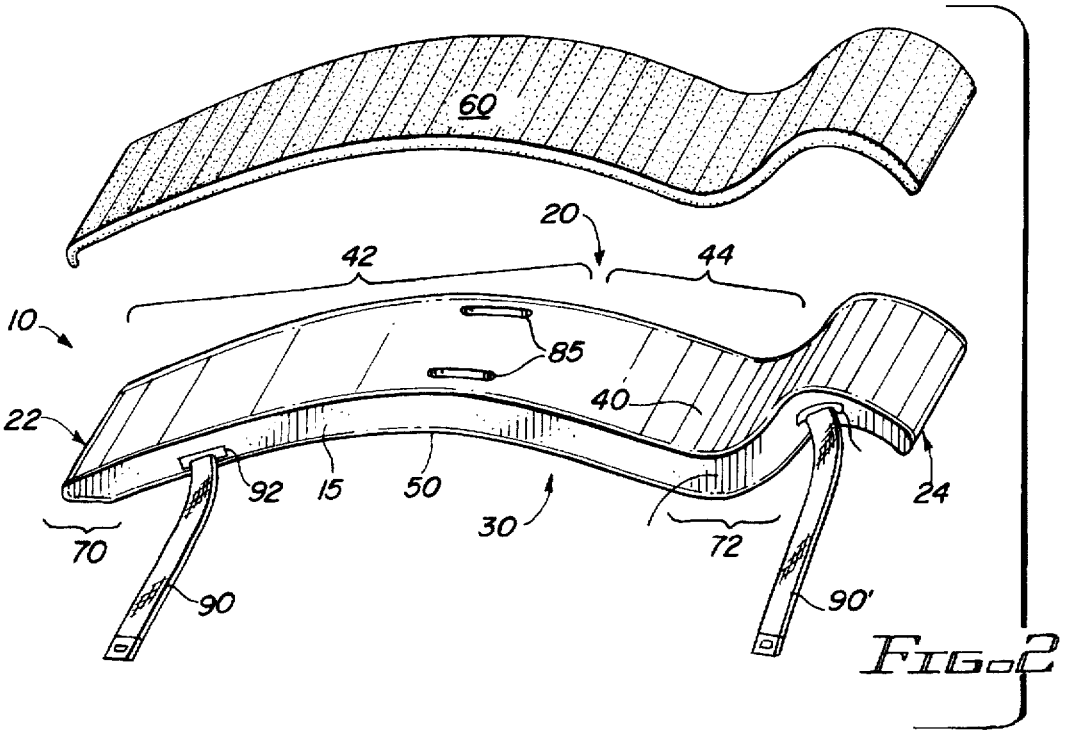
FIG. 2 is an exploded side view of the invention shown in FIG. 1, illustrating a cushion member to be disposed and secured thereon and illustrating means for mounting the device onto a standard exercise bench.
Figure 3:
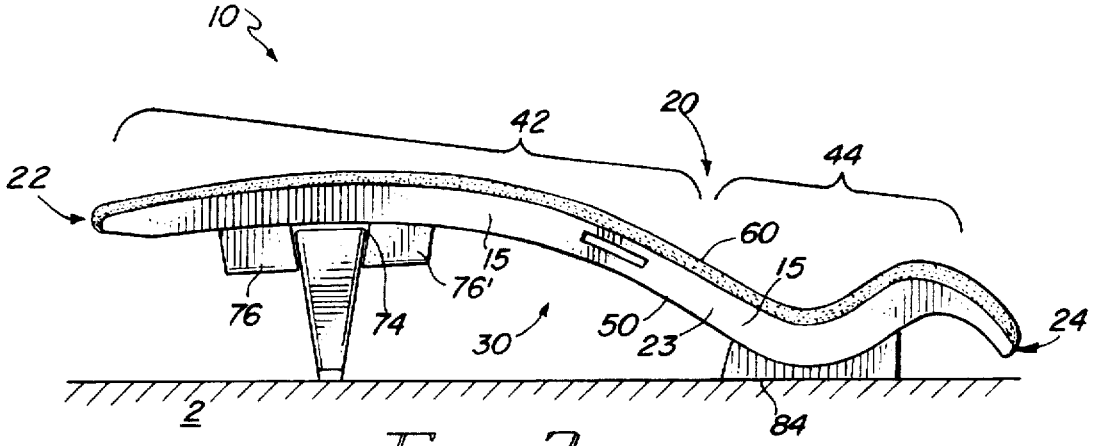
FIG. 3 is a side view of the stretching and exercise device illustrating means for elevating the device comprising a jack member and a pair of elongate members, and means for stabilizing the device in an operative position.

Referring now to FIGS. 1–3, a preferred embodiment of the present invention is illustrated. In this embodiment, the stretching and exercise device 10 is seen to comprise a platform 15 formed of a rigid material so as to support an exerciser's body weight thereon and further, is structured to be supported on a common planar surface 2 such as the floor of a gym or even on a work-out bench. The platform 15 may be formed from a variety of rigid materials such as wood, fiberglass, or a suitably rigid plastic material, such a urethane or polyurethane plastic. Ideally, the material used to form the platform 15 will be lightweight, for instance, between generally about five to twenty pounds, so as to aid the goal of offering a readily portable device, and will also be relatively inexpensive to manufacture. In one preferred embodiment, however, the platform 15 may be formed of an elegant wood material, such as Mahogany or Oak, which may be finely sanded, stained and polished in order to give the exercise device 10 a pleasing and aesthetic appearance. Also in the preferred embodiment, the platform 15 includes a one-piece construction that may be integrally formed, although the platform 15 could be formed of a plurality of separate pieces securely joined or possibly even removably joined together so as to form the exercise device 10. Regardless of the material used to form the exercise device 10, it will have in a most preferred embodiment, an overall size that is both compact and easily portable. Ideally, the dimensions of the device will be generally about thirty-six (36") inches in length by generally about twelve (12") inches in width and generally about two (2") inches in depth. Further, the device will ideally be sized to have a height when measured from the ground or common planar support surface 2, which varies between the ends of the platform from generally about two (2") inches to generally about six (6") inches. It will be appreciated that these preferred dimensions of the device 10 lend the device to being easily stored under a bed, in a carrying case or even in an overhead compartment on an aircraft.

Referring to FIG. 1, the platform 15 of the stretching and exercise device 10 can be said to comprise a top region 20 and a bottom region 30. At least the top region 20 of the platform 15, and preferably both the top region 20 and the bottom region 30, includes a first end zone 22 and a second end zone 24. In addition, a unique feature of the present exercise device 10 is that at least the top region 20 of the platform 15 defines an upper support surface 40 which has a generally sinusoidal configuration or a generally horizontal "S" shaped configuration between the first end zone 22 and the second end zone 24. In a most preferred embodiment, and as illustrated in FIGS. 1 and 2, the bottom region of the platform 15 includes a bottom surface 50 which also has a generally sinusoidal configuration between the first end zone 22 and the second end zone 24, which corresponds to that of the upper support surface 40. As is more clearly illustrated in the drawings, in either embodiment, the upper support surface 40 of top region 20 comprises a convex support portion 42 and a concave cradle portion 44. The convex support portion 42 is structured and disposed to provide reclining support for at least part of an exerciser's back when the exerciser performs stretching, sit-up or warm-up type exercises on the device 10. More specifically, the convex support portion 42 is seen to comprise a generally arcuate or semi-circular configuration which is structured and disposed to support the exerciser's back and further, to cause the back to arch as he or she reclines against convex support portion 42. It should be noted that the exerciser does not have to lean completely back in the device 10 against the convex support portion 42 for the arching effect to begin as even a partial recline will cause the back to comfortably arch. Additionally, it will be appreciated that by gently causing the exerciser to arch his or her back in performing sit-up type exercises, the exerciser's chest cavity expands, and that this results in the exerciser breathing more deeply and also in the stretching of the exerciser's back muscles. Consequently, the present device may be utilized to ease tension, to help improve posture and to prevent stress related injuries. Disposed adjacent the convex support portion 42 is the concave cradle portion 44. More preferably, the top region 20 also comprises an intermediate zone 23 between the first and second end zones 22, 24, such that the convex support portion 42 is seen to extend from the first end zone 22 to the intermediate zone 23, and further such that the concave cradle portion 44 is seen to extend from the intermediate zone 23 to the second end zone 24. It will be appreciated in any event from the drawings, that the concave cradle portion 44 is structured and disposed for supporting and cradling the exerciser's buttocks during the performance of exercises on the device 10, in a manner which prevents him or her from sliding on the device 10.

Still referring to FIGS. 1 and 2, in a most preferred embodiment, the bottom surface 50 of the present invention is seen to include a first contact region 70 and second contact region 72. First and second contact regions 70, 72 are structured and disposed to contact the floor or other common planar surface 2 and to support the exercise device 10 thereon in an orientation substantially parallel thereto. The first contact region 70 is preferably disposed so as to generally correspond the first end zone 22 of the platform and the second contact region 72 is preferably disposed so as to generally correspond the intermediate zone 23, generally at the intersection of the convex support portion 42 and the concave cradle portion 44. It will be readily understood that with this preferred embodiment of the device 10, wherein both the upper support surface 40 and the bottom surface 50 have a generally sinusoidal shape, a plurality of the exercise devices 10 may be easily stacked in a vertically extending and nesting arrangement, one-on-top-of-the-other, for convenient and space saving storage. It will also be appreciated that in an alternative embodiment, the device 10 could also include a third contact region disposed to generally correspond the second end zone 24, without interfering with the stacking capability of the device 10 in the preferred embodiment.

It will be readily understood that because the exerciser directly contacts the upper support surface 40 of the device 10, it is preferable to provide a cushion 60 therefor, to provide comfort. The cushion 60, as best shown in FIG. 2, can be secured to the upper support surface 40 in a wide variety of ways. While the cushion 60 may be fixedly secured to the device 10 by way of adhesives or conventional fasteners such as screws, in a preferred embodiment the cushion 60 will be removably attached to the upper support surface 40 of the device 10, by way of snaps, buttons, a hook and loop fastening material, straps, or the like. In this way, the cushion 60 can be detached from the exercise device 10 for washing so as to remove odor or stains caused by sweat. Thus, in one preferred embodiment, the cushion 60 is constructed of a fabric or cloth material that can be removed for washing or other cleaning. In another preferred embodiment, the cushion 60 may be formed of a soft, water resistant fabric, of a vinyl material, or even of a soft leather material. In any case, in a more preferred embodiment, the cushion 60 will include at least one layer of foam padding and ideally, two layers of foam padding, beneath the outer exposed material of the cushion 60.

In the preferred embodiment, the stretching and exercise device 10 will also include at least one handle 85 thereon. In the most preferred embodiment, the handle 85 will be integrally formed within the device 10 as an opening in the upper surface 40 of the platform 15 as shown in FIG. 2. As shown in FIG. 1, the handle 85 may alternatively be formed in the side 15 of the exercise device 10. Alternatively, the handle 85 may be comprised of a separate metal or wood handle and operably connected to the device 10, by way of conventionally known fasteners, such as bolts, screws, and the like, and will preferably also be located on the side of the device 10. It will be readily appreciated that handle 85 provides means for easily transporting the device 10 from location to location, whether for traveling or for transporting the device from home to a gym, as is about to be described.

The stretching and exercise device 10 of the present invention may be disposed in an operative position, ready for use by an exerciser, directly on the ground or any other floor surface. Alternatively, the device 10 may be disposed in an operative position ready for use on a standard exercise bench, also known as a work bench, which are commonly found in many gyms and health clubs for purposes such as performing sit-up type exercises in an elevated or inverted position. While certain exercise benches are permanently affixed in one position, others are movable so as to adjust the incline of the bench, and thus the difficulty for performing a sit-up type of exercise can be varied. Further, it will be readily understood that the exercise device 10 may be mounted on an inclined exercise bench in either a "head-elevated" position or a "feet elevated" position. While the device 10 may simply be placed on an exercise bench 60 for use, in a more preferred embodiment, the exercise device 10 will include means for mounting the exercise device onto a standard exercise bench. In the preferred embodiment, as shown in FIG. 2, the mounting means comprise at least one strap 90. Preferably, the strap 90 will be operably connected at one end thereof to the exercise device 10. For example, the platform 15 may include therein one or more receiving slots 92, preferably located on the side of the platform 15 which is structured and disposed for securely connecting the strap 90 to the device 10. The strap 90 should be of sufficient length to wrap down around the sides of the exercise device 10 and the exercise bench and to pass thereunder and back up to another receiving slot 95 in the opposite side of the platform 15 for fastening. Alternatively, where the device 10 is formed to have two handles 85, such as one on each side of the device 10, a single strap may be passed through each handle 85, under or over the device 10 and about a standard exercise bench. Alternatively, device 10 may include another strap 90' in mirror image to strap 90, which is operably connected to the opposite side of the exercise device 10 as the strap 90 so that both can then be tied, buckled, snapped, or Velcroed™ together to snugly retain the exercise device 10 on the exercise bench.

Figure 4:
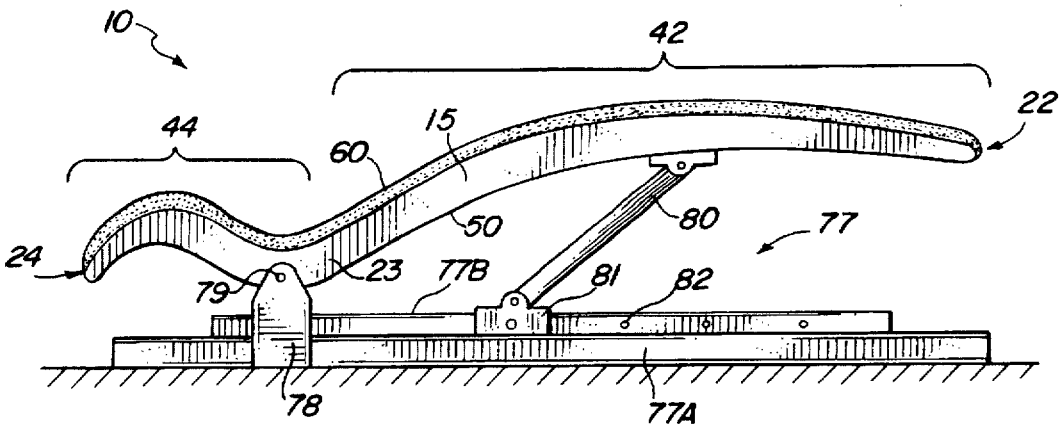
FIG. 4 is a side view of the stretching and exercise device wherein the means for elevating the device comprise an extender arm connected to the device and also movably coupled to a rigid frame structure supported on a floor surface.

Referring now to FIG. 3, the stretching and exercise device 10 of the present invention preferably also includes means for elevating all or part of the device relative to the floor or other common planar surface. In one embodiment, the elevating means may be directed towards elevating the convex support portion 42 of the upper support surface 40 relative to floor or other common planar surface. In this embodiment, the elevating means preferably comprise a jack member 75 and a pair of elongate members 76, 76' as is about to be described. The pair of elongate members 76, 76' are preferably secured to the bottom surface 50 of the platform 15, and further, are disposed in a position on bottom surface 50 which is generally centered under the convex support portion 42. Ideally, the pair of elongate members 76, 76' are spaced apart a small distance from one another so as to define a gap 74 therebetween. The jack member 75 is structured and disposed to be slidably and yet snugly received in the gap 74 between said elongate members. It will be appreciated however, that the jack member 75 may be operably connected to the platform 15 in other ways, apart from this preferred embodiment, wherein the jack member 75 is configured to slide in place and is removably secured in place by elongate members 76 and 76'. Both the jack member 75 and elongate members 76, 76' may be formed of wood, plastic, fiberglass, or other rigid materials but preferably, the same material used to construct the platform 15 will be used to construct the jack member 75 and elongate members 76, 76'. In another embodiment, the elevating means may be directed towards not only to elevating the convex support portion 42 relative to the floor 2 but also, or perhaps even separately, elevating the entire device 10 off of the floor or other common planar surface 2. In this embodiment, the elevating means will preferably comprise a rigid frame structure 77 to be supported on a floor surface and also securely and yet movably coupled to device 10 or 110. For example, and as illustrated in FIG. 4, rigid frame structure 77 may comprise a plurality of similarly sized leg members 77*a*, 77*b*, 77*c*, 77*d* connected together for contacting the floor or common planar surface 2 and stabilizing the device thereon when the elevating means are being used. The device 10, 110, may then be operably coupled to the rigid frame structure 77, for example, by way of brackets 78 or a laterally extending pin through the device 10 at intermediate zone 23 and conventional fasteners 79, such as depicted in FIG. 4. Additionally, an extender arm 80 may then be operably coupled between a central, longitudinally extending one of the leg members 77*b*, and the bottom surface 50 of the device generally under convex support portion 42. The extender arm 80 may be movably connected to leg member 77*d* to permit movement therealong, perhaps by way of mating peg and hole or other male/female structure formed thereon or connected thereto, see 81, 82 in FIG. 5. It will thus be appreciated that upon movement of extender arm 80 from an orientation such as shown in into a more vertical orientation, such as shown in FIG. 4, the convex support portion 42 can be elevated relative to the floor 2. If desired, extender arm 80 may instead be formed so as to telescope between a first closed position and a second position where convex support portion 42 will be alleviated with respect to the floor 2. Further, it will be appreciated that by incorporating a plurality of movable elevating arms secured to and disposed on opposite sides of the device 10, 110, which elevating arms are also operably connected to the rigid frame structure 77, that the entire device 10, 110 could be also moved or elevated within a vertical plane and yet, if desired, remain substantially parallel to the common planar surface or floor 2. In this way, the device 10, 110 could be elevated for use by an elderly person who is unable to bend or move so as to seat themselves on the device if it were located only on the floor.

Referring again now to FIG. 3, in the preferred embodiment, the stretching and exercise device 10 of the present invention will also include means for stabilizing the device 10 in the operative position, when the exerciser is performing stretching or sit-up type exercises thereon. In the preferred embodiment, the stabilizing means comprise a stabilizer element 84 as shown in FIG. 3. The stabilizer element 84 provides additional stability to the exercise device 10 and helps to prevent the exercise device from sliding, rocking, or otherwise moving while in use. Both the stabilizer element 84 and the jack member 75 may be formed of wood, plastic, fiberglass, or other rigid materials. However, it is preferred that the same material be used to construct the stabilizer element 84 as is used to construct the platform 15. Ideally, the stabilizer element 84 will have a generally rectangular shape and dimensions of generally about twenty-five (25") inches by twelve (12") inches.

Figure 5:
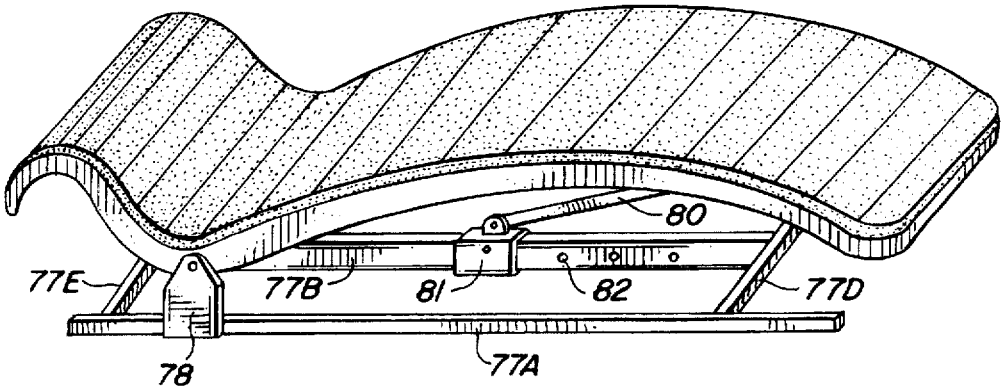
FIG. 5 is a side perspective view of the invention depicted in FIG. 4.
Figure 6:
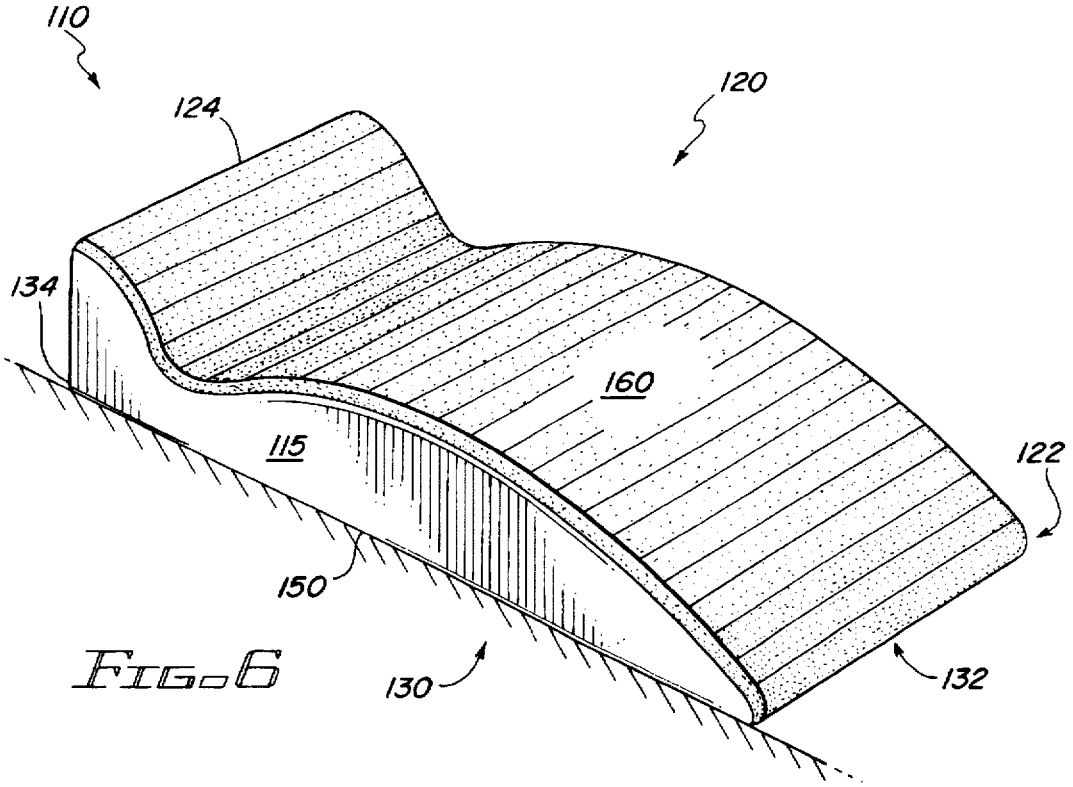
FIG. 6 is a perspective view of an alternative embodiment of the exercise device of the present invention.
Figure 7:
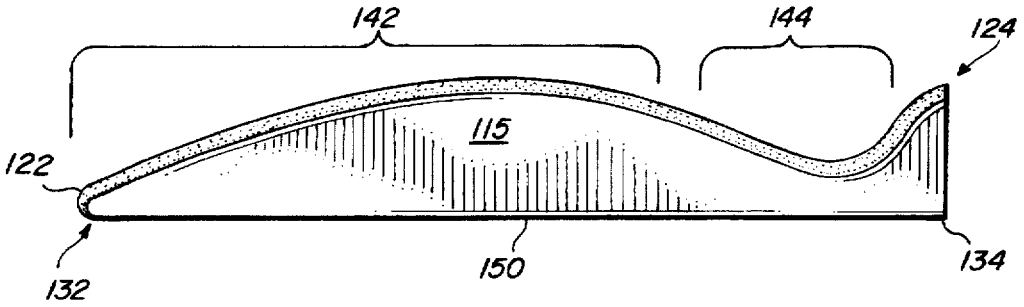
FIG. 7 is a side view of the embodiment of the present invention depicted in FIG. 6.

Referring now to FIGS. 6 and 7, there is shown an alternative embodiment of the stretching and exercise device, designated generally as 110. Device 110 is substantially similar to device 10 which has already been described and will not be repeated here. As in the preferred embodiment 10, the alternative embodiment 110 has a platform 115 comprising a top region 120 and a bottom region 130. As in the preferred embodiment, the bottom region 150 and ideally, the top region 120 as well, extend between a first end zone 132 and a second end zone 134. However, as shown in FIGS. 5 and 6, the bottom region 150 of the alternative embodiment 110 has been adapted so that it is substantially flat and therefore in the operative position, is structured and disposed to substantially contact and support the device 110 on a common planar surface such as a floor or exercise bench. The device 110 further has a pair of substantially parallel opposite sidewalls 115 extending from the bottom surface 150 to the top region 120 as shown in FIGS. 5 and 6. As in the preferred embodiment, the top region 120 of the device 110 defines an upper support surface which has a generally sinusoidal configuration or a generally horizontal "S" shaped configuration between the first and second end zones 132 and 134. The upper support surface of device 110 further includes a convex support portion 142 structured and disposed to support an exerciser's back and to cause the back to arch as he or she reclines thereagainst, and a concave cradle portion 144 structured and disposed for supporting and cradling the exerciser's buttocks during the performance of exercises on the device 110.

The operation of the described invention is believed to be readily apparent. An exerciser first selects whether to use the device on the floor, mat, exercise bench, or any of these in combination with the elevating means and/or stabilizer means. By experimenting with these accessories, the exerciser can select among a variety of degrees of incline and thus, difficulty levels for using the device to perform sit-up type exercises on the device 10, 110. Next, the exerciser sits on the cushion 60 covering the upper support surface 40 of the exercise device 10 and 110, with feet on the floor, knees up, and with his lower back in touching contact with the exercise device 10, 110. The exerciser then slowly leans back onto the device, allowing each vertebra of the lower back and then those of the upper back to adjust to the arcuate configuration of the convex support portion 42 of the device, which simultaneously, causes the exerciser's chest cavity to expand, thereby facilitating deeper breathing. If desired, the exerciser can start raising his torso upwardly to an inclined position to perform a sit-up type of exercise whereupon the device 10, 110 will support his back and in particular, minimize pressure to his lower back. Of course, the exerciser may simply use the device 10, 110 to stretch and hyperextend the back muscles or may choose to perform various exercises on the device and as many repetitions of each exercise as desired. It should be born in mind as well however, that the device of this invention can also be effectively used as an aid to warm up the exerciser's body in preparation for other workouts, such as walking, jogging, aerobics, etc.

Since many modifications, variations and changes in detail can be made to the described preferred embodiment of the invention, it is intended that all matters in the foregoing description and shown in the accompanying drawings be interpreted as illustrative and within the scope and spirit of this invention, and not in a limiting sense. Thus, the scope of the invention should be determined by the appended claims and their legal equivalents.

Now that the invention has been described,

What is claimed is:

1. An exercise device comprising:

a) a platform formed of a rigid material, said platform structured and disposed for supporting an exerciser's body weight thereon; said platform including a top region, a bottom region, a first end zone and a second end zone, b) said top region of said platform defining an upper support surface for contacting and supporting the exerciser thereon; said upper support surface having a generally sinusoidal configuration between said first and second end zones, said upper support surface further including:

i) a convex support portion for supporting a substantial portion of the exerciser's back, said convex support portion causing the exerciser's back to at least partially arch when the exerciser reclines against said convex support portion;

ii) a concave cradle portion for supporting and cradling the exerciser's buttocks during the performance of exercises on said device;

c) said bottom region defining a bottom surface having a generally sinusoidal configuration between said first and second end zones corresponding said generally sinusoidal configuration of said upper support surface; and d) said bottom region of said platform structured and disposed to contact and support said device on a common planar surface when said device is in an operative position.

2. An exercise device as recited in claim 1 wherein said bottom region of said platform further comprises a first and a second contact region disposed on said bottom surface, said first and second contact regions structured and disposed to contact the common planar surface and permit said exercise device to be supported thereon in an orientation substantially parallel to the common planar surface.

3. An exercise device as recited in claim 1 wherein said platform further defines an intermediate zone between said first and second end zones, and said convex support portion of said upper support surface extends from said first end zone to said intermediate zone, and said concave cradle portion of said upper support surface extends from said intermediate zone to said second end zone.

4. An exercise device as recited in claim 3 wherein said bottom region of said platform further comprises a first and a second contact region disposed on said bottom surface, said first and second contact regions structured and disposed to contact the common planar surface and permit said exercise device to be supported thereon in an orientation substantially parallel to the common planar surface.

5. An exercise device as recited in claim 4 wherein said first contact region of said bottom surface is disposed at said first end zone of said platform and said second contact region of said bottom surface is disposed at said intermediate zone.

6. An exercise device as recited in claim 5 further comprising means for elevating said device relative to the common planar surface.

7. An exercise device as recited in claim 6 wherein said means for elevating said device comprise:

a) a pair of elongate members secured to said bottom surface of said platform at a position generally centered under said convex support portion; each of said elongate members disposed at a spaced apart distance from the other so as to define a gap therebetween; and b) a jack member structured and disposed to be slidably and yet snugly received in said gap between said elongate members.

8. An exercise device as recited in claim 7 further comprising means for stabilizing said device in the operative position and when the exerciser is performing exercises thereon.

9. An exercise device as recited in claim 1 further comprising at least one handle formed on said platform.

10. An exercise device as recited in claim 1 wherein said exercise device is sized to be generally about thirty-six (36") inches in length, generally about twelve (12") inches in width and is sized to have a height which varies between said end zones from generally between two (2") inches to generally about six (6") inches.

11. An exercise device as recited in claim 1 further comprising means for mounting said device on an exercise bench.

12. An exercise device as recited in claim 1 wherein said platform is constructed of a wood material and formed to have a high gloss appearance.

13. An exercise device as recited in claim 1 further comprising a cushion removably secured to said device and sized and configured to substantially cover at least said upper support surface of said device.

14. An exercise device as recited in claim 1 wherein said platform includes a one piece, integrally formed construction.

15. An exercise device as recited in claim 1 wherein a plurality of said devices may be stacked vertically in a nested arrangement for storing said devices in a minimal amount of space.

* * * * *